US005095803A

United States Patent [19]

Allais et al.

[11] Patent Number: 5,095,803

[45] Date of Patent: Mar. 17, 1992

[54] ARMORED TURRET HAVING AN AUXILIARY WEAPON

[75] Inventors: Jean-Philippe P. B. Allais, Montivilliers; Alain R. Guillermond, Epouville; Didier J. D. Lenormand, Le Havre, all of France

[73] Assignee: Societe Anonyme Dite Hispano Suiza, Saint Cloud Cedex, France

[21] Appl. No.: 634,523

[22] Filed: Dec. 27, 1990

[30] Foreign Application Priority Data

Dec. 28, 1989 [FR] France ..... 89.17297

[51] Int. Cl.[5] ..... F41G 5/24

[52] U.S. Cl. ..... 89/40.03; 89/41.16; 89/37.07

[58] Field of Search ..... 89/37.02, 41.16, 37.03, 89/37.05, 37.13, 40.02, 40.03, 41.22, 36.13, 36.14, 34, 37.07, 37.22

[56] References Cited

U.S. PATENT DOCUMENTS

| | | | |
|---|---|---|---|
| 2,334,152 | 11/1943 | Trotter | 89/37.03 |
| 2,370,148 | 2/1945 | Colby | 89/36.13 |
| 2,466,725 | 4/1949 | Minter | 89/40.03 |
| 2,594,198 | 4/1952 | Motley | 89/36.13 |
| 3,424,052 | 1/1969 | Ruf | 89/40.03 |
| 4,336,743 | 6/1982 | Horn et al. | 89/37.03 |
| 4,489,639 | 12/1984 | Winkler et al. | 89/36.13 |

FOREIGN PATENT DOCUMENTS

| | | | |
|---|---|---|---|
| 068166A2 | 1/1983 | European Pat. Off. . | |
| 977983 | 9/1974 | Fed. Rep. of Germany . | |
| 3119621A1 | 12/1982 | Fed. Rep. of Germany . | |
| 2459447 | 1/1981 | France | 89/37.02 |

OTHER PUBLICATIONS

French Search Report (Oct. 5, 1990).

*Primary Examiner*—Stephen Johnson

*Attorney, Agent, or Firm*—Bacon & Thomas

[57] ABSTRACT

An armored turret for a light-armored vehicle is disclosed having an auxiliary weapon mounted on the side of the turret by a hollow support arm. A control mechanism for operating the gun extends from the interior of the turret through the hollow arm and is connected to the auxiliary weapon to enable the operator to operate the auxiliary weapon from inside the turret. The auxiliary weapon is pivotally attached to the auxiliary weapon mount to enable it to be elevated about an elevation axis extending substantially parallel to the elevational axis of the primary weapon. A mechanical linkage device interconnects a shaft, which is rotated by the elevation changes of the primary weapon and the auxiliary weapon such that any elevational changes in the primary weapon are imparted to the auxiliary weapon. The linkage is mounted externally of the turret.

11 Claims, 3 Drawing Sheets

ARMORED TURRET HAVING AN AUXILIARY WEAPON

BACKGROUND OF THE INVENTION

The present invention relates an auxiliary weapon supported on an armored turret of a light-armored vehicle. Such vehicles are designed for maintaining order, anti-guerilla activities, safe travel on rough terrain and in urban centers. In combat zones, the vehicles are intended to neutralize points of resistance, clean-up operations, etc.

As a rule, this type of light-armored vehicle is equipped with a turret including a primary weapon capable of being elevated about an elevation axis which extends generally transversely across the front of the turret. The primary weapon, for example, may comprise a 60 mm mortar, 12.7 caliber machine guns or the like. These vehicles may also be equipped with a mortar and a 12.7 caliber machine gun or one 60 mm mortar and two machine guns of lesser caliber, such as 7.62 mm for the primary weapons.

SUMMARY OF THE INVENTION

An armored turret for a light-armored vehicle is disclosed having an auxiliary weapon mounted on the side of the turret by a hollow support arm. A control mechanism for operating the gun extends from the interior of the turret through the hollow arm and is connected to the auxiliary weapon to enable the operator to operate the auxiliary weapon from inside the turret.

The auxiliary weapon is pivotally attached to the auxiliary weapon mount to enable it to be elevated about an elevation axis extending substantially parallel to the elevational axis of the primary weapon. A mechanical linkage device interconnects a shaft, which is rotated by the elevation changes of the primary weapon and the auxiliary weapon such that any elevational changes in the primary weapon are imparted to the auxiliary weapon. The linkage is mounted externally of the turret.

The auxiliary weapon endows such light-armored vehicles with the capability of successfully engaging well armored targets, such as light or heavy tanks. Such auxiliary weapons provide further armament to the light-armored vehicle, but retain its basic armament, its lightness, its flexibility and its mobility.

The auxiliary weapon may comprise a 40 mm grenade launcher which is capable, depending upon the type of ammunition, of piercing 50 mm armor at 0° angle of incidence and having highly effective anti-personnel effects up to a distance of approximately 1,500 m. The invention also includes an externally mounted rack capable of carrying additional ammunition cases for the auxiliary weapon, thereby increasing its fire power.

The mechanical linkage interconnecting the primary weapon and the auxiliary weapon may consist of a shaft extending substantially co-axially with the elevation axis of the primary weapon such that elevation of the primary weapon causes the shaft to rotate about the elevational axis. A link rod member interconnects a crank arm attached to this shaft with the auxiliary weapon support which pivotally supports the auxiliary weapon so as to enable it to undergo elevational changes about a second elevational axis extending generally parallel to the elevational axis of the primary weapon. Thus, this linkage transfers any change in elevation of the primary weapon to the auxiliary weapon, thereby eliminating the need for any separate elevational changing system for the auxiliary weapon. Lines connecting the end pivot points of the link rod member and the first and second elevational axes located in a plane extending generally perpendicular to these axes defines a parallelogram quadrilateral to ensure that all of the elevational changes of the primary weapon are transferred to the auxiliary weapon.

The auxiliary weapon may also include a mechanical breech reloading system actuated by a lever located in the interior of the turret. The control lever is linked to the breech reloading system by a cable-type mechanical transmission which extends through the hollow support arm and is connected to the auxiliary weapon.

DETAILED DESCRIPTION OF THE PREFERRED EMBODIMENT

Figure 1:
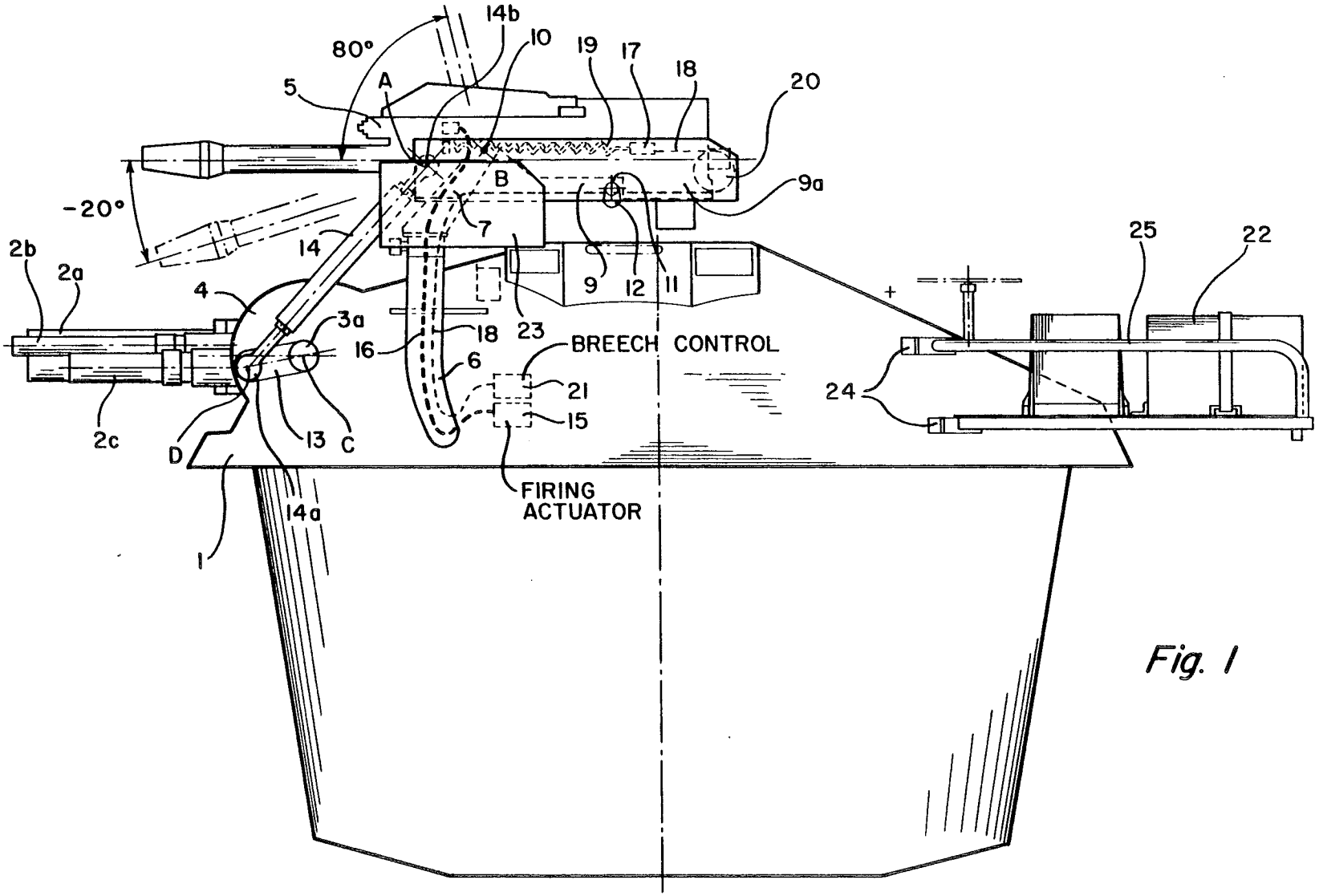
FIG. 1 is a side elevation view of a turret for a light-armored vehicle incorporating the auxiliary weapon according to the present invention.
Figure 2:
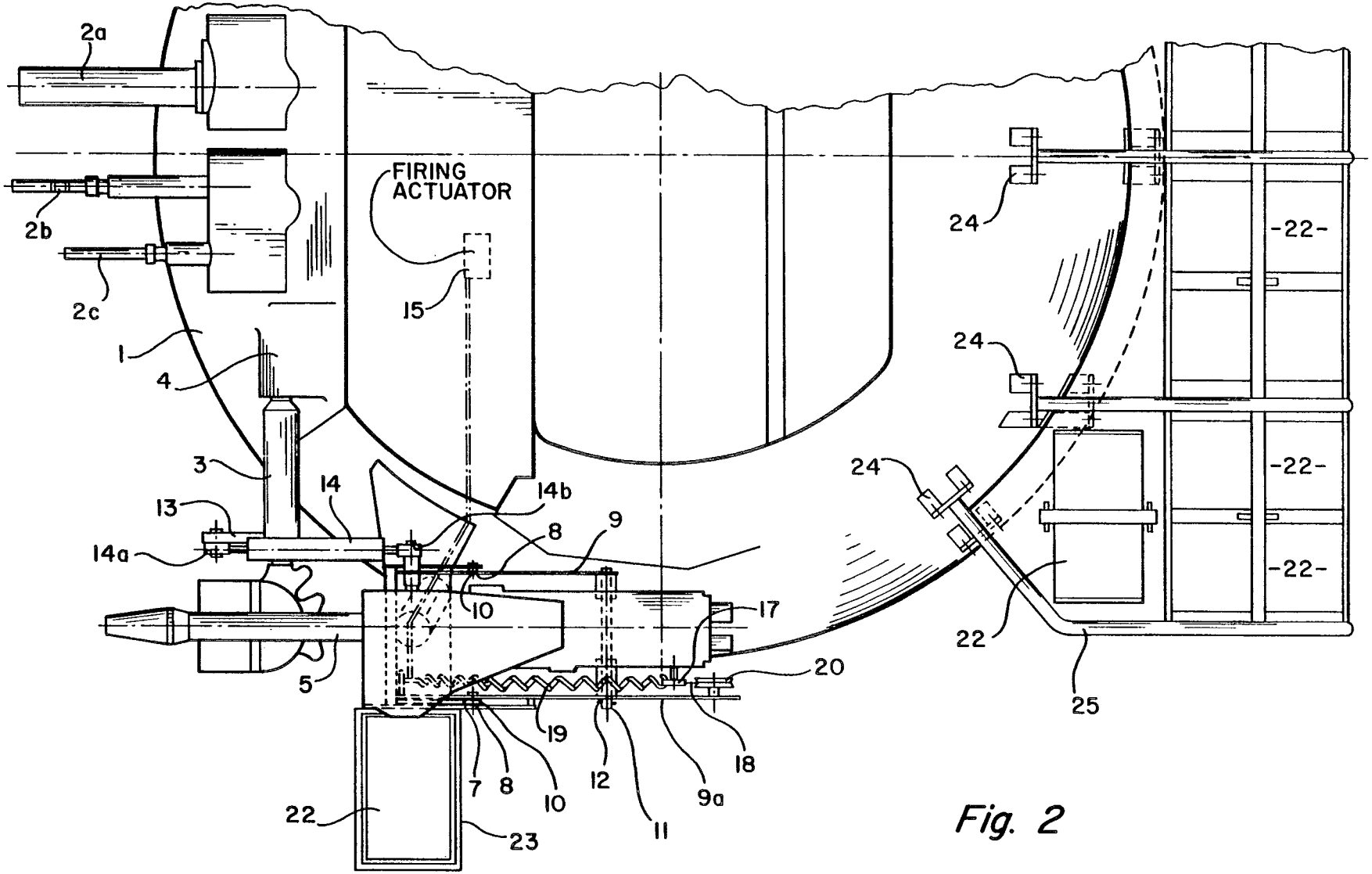
FIG. 2 is a partial, top plan view of the light-armored vehicle turret shown in FIG. 1.
Figure 3:
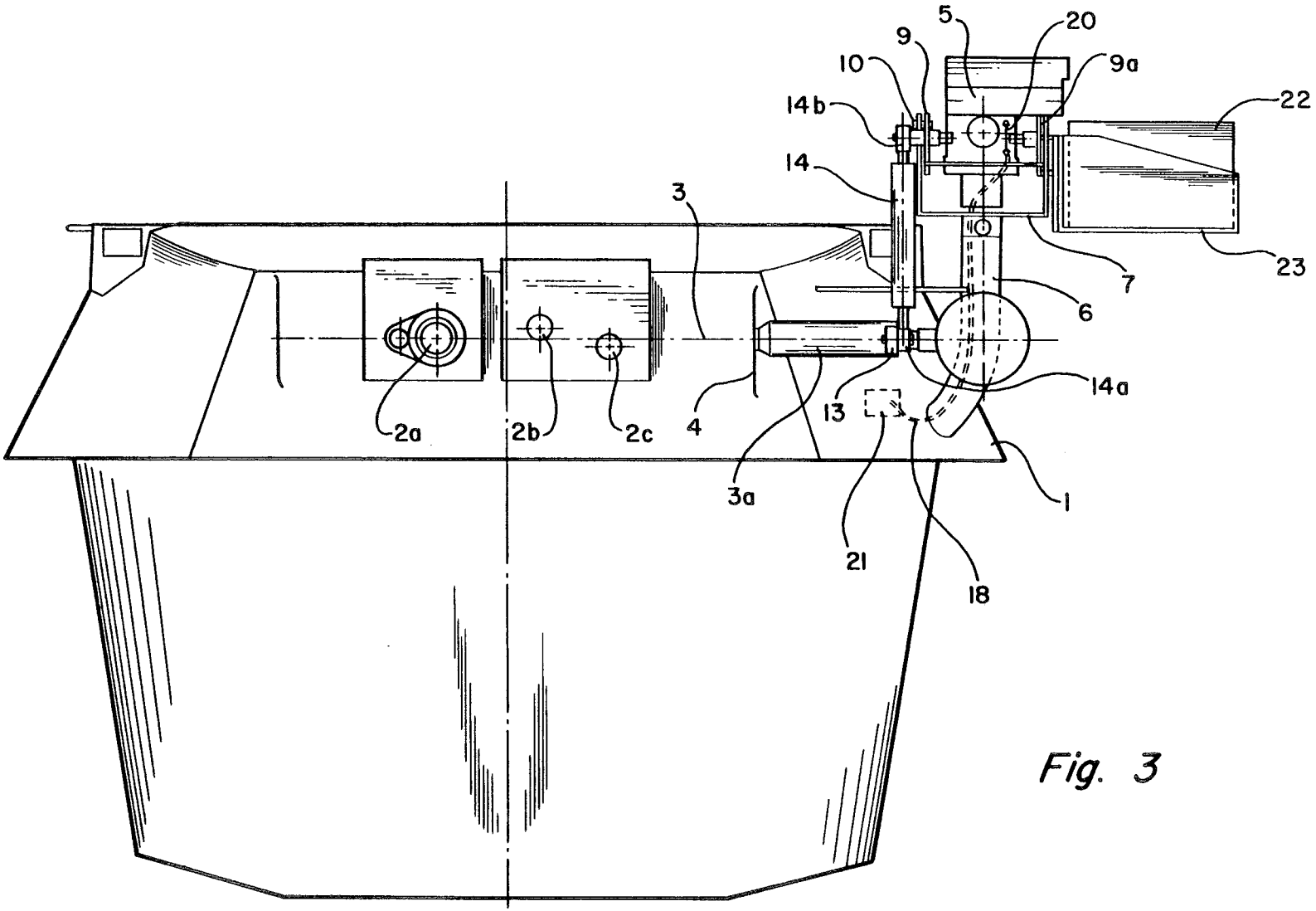
FIG. 3 is a front elevational view of the light-armored vehicle turret shown in FIGS. 1 and 2.

As illustrated in the figures, the improved turret according to the present invention comprises a turret body 1 having at least one primary weapon extending from the front of the turret 1. The primary weapon may comprise a 60 mm mortar 2*a*, a 12.7 mm machine gun 2*b* and/or a 7.62 mm machine gun 2*c*. The primary weapons may be used in combination or individually.

As is well-known in the art, the turret 1 comprises means to elevate the primary weapons about an elevational axis C extending generally transversely across the front of the turret. The primary weapons may undergo such elevational changes either jointly or separately.

A shaft 3 extending substantially co-axially with the first elevational axis C extends externally of the turret 1 from a cylindrical bearing housing 4 on the turret body.

According to the present invention, an auxiliary weapon 5 is mounted externally to the side of the turret 1 by a hollow support arm 6. The hollow interior of the support arm 6 communicates with the interior of the turret 1. A generally U-shaped fork member 7 is fixedly attached to the end of the hollow arm 6 and pivotally supports a cradle member 9 through pivot bearings 8. The pivot bearings 8 define a second elevational axis B extending substantially parallel to the first elevational axis C. The auxiliary weapon 5 is fixedly attached to the cradle member 9 by at least one transverse spindle 11 incorporating a fastening ring 12.

The elevational changes of the primary weapon are transferred to the auxiliary weapon 5 by a mechanical linkage system mounted externally of the turret. This linkage system comprises a crank arm 13 attached to the shaft 3 near an end 3*a*. A link rod member 14 has a first end pivotally connected to the crank 13 by pivot attachment 14*a* and a second end pivotally attached to a cradle member 9 by pivot attachment 14*b*. The pivoting attachments 14*a* and 14*b* may be adjustably attached to the link rod member 14 to enable the distance between them to be varied.

As best seen in FIG. 1, the axis of pivot attachment 14*b* is denoted at A and extends generally parallel to the second elevational axis B. Similarly, the axis of pivoting attachment 14*a*, denoted by D, extends substantially parallel to the first elevational axis C. Lines interconnecting points A, B, C and D located in a plane extending substantially perpendicular to the elevational axes forms a parallelogram quadrilateral linkage such that the elevational displacement of the primary weapons is duplicated by the auxiliary weapon 5. As illustrated in FIG. 1, the elevation of the auxiliary weapon 5 may be varied from approximately −20° to +80°.

The elevation of the auxiliary weapon 5 may be adjusted by extending or contracting the link rod member 14 by changing the distance between the pivot attachments 14*a* and 14*b*. These may be adjusted by a known screw-nut system so as to effectively vary the length of the link rod member 14.

It is envisioned that the auxiliary weapon 5 will be equipped with an electric triggering system activated by firing mechanism actuator 15 located in the interior of the turret 1. Actuator 15 is electrically connected to the firing mechanism by electrical connection 16 which extends through the interior of the hollow arm 6.

If the auxiliary weapon comprises a grenade launcher, it may lack an inertial breech, such as those provided in machine guns, and be provided with a mechanical system 17 for resetting the breech actuated from inside the turret 1. In this system, slide means extending through the breech case can be moved rearwardly against the force of spring 19 by a cable 18. Cable 18 passes partially around the pulley 20, which is rotatably affixed to the sidewall 9*a* of the cradle member 9, and passes through the interior of hollow support arm 6 such that it may be connected with a control lever 21 mounted in the interior of the turret 1.

The cradle member 9 may comprise a sidewall 9*a* to cover and protect the rear portion of the auxiliary weapon 5. The control cable 18 for the mechanical resetting system is elastically prestressed and returned forward by the return spring 19 having its forward end affixed to the front portion of the cradle member 9.

The invention also provides for an ammunition system for supplying ammunition to the auxiliary weapon 5. This ammunition may be of the belt-type and may be placed in standard ammunition containers 22. An ammunition support 23 is affixed to and extends from the side of the cradle member 9 in order to support the container 22 in its proper position for supply ammunition to the auxiliary weapon 5.

In addition to this ammunition container, an external rack 25 may be attached to the rear portion of the turret via bosses 24 so that additional ammunition cases 22 may be carried on the vehicle. If auxiliary weapon 5 comprises a grenade launcher, it is envisioned that each ammunition container would hold 25 grenades thereby enabling 275 shots (25 in the ammunition container adjacent to the auxiliary weapon and 250 in the storage rack).

The invention envisions the use of any known auxiliary weapon such as grenade launchers or machine guns. By adding such auxiliary weapons to the light-armored vehicle, it adds significantly to the fire power of the vehicle and adds new operational capacities which significantly enhance its usefulness.

The foregoing description is provided for illustrative purposes only and should not be construed as in any way limiting this invention, the scope of which is defined solely by the appended claims.

We claim:

1. An armored turret for a light-armored vehicle having at least one primary weapon movable in elevation about a first elevational axis extending generally transversely of the turret, comprising:

(a) an auxiliary weapon;

(b) mounting means mouting the auxiliary weapon on the exterior of the turret such that its elevation is adjustable, the mounting means having a hollow support arm extending from the turret such that the interior of the support arm communicates with the interior of the turret;

(c) means for operating the auxiliary weapon from inside the turret, the operating means connected to the auxiliary weapon through the hollow support arm; and (d) linkage means interconnecting the auxiliary weapon and the primary weapon such that the elevation angle of the auxiliary weapon corresponds to the elevation angle of the primary weapon, wherein the linkage means comprises:

(i) a shaft extending exteriorly of the turret substantially coaxially with the first elevational axis, the shaft operatively associated with the primary weapon such that elevational movement of the primary weapon causes the shaft to rotate about the first elevational axis;

(ii) a crank arm connected to the shaft; and, (iii) a link rod member connected to the crank arm and to the mounting means.

2. The armored turret of claim 1 wherein the mounting means comprises:

(a) a generally U-shaped fork member fixedly attached to the hollow support arm;

(b) a cradle member having the auxiliary weapon attached thereto; and, (c) pivot means pivotally attaching the cradle member to the fork member so as to define a second elevation axis about which the auxiliary weapon may pivot, the second elevational axis extending generally parallel to the first elevational axis.

3. The armored turret of claim 2 further comprising:

a) a first pivot attachment pivotally attaching a first end to the link rod member of the crank arm; and, b) a second pivot attachment pivotally attaching a second end of the link rod member to the cradle member such that lines interconnecting the first pivot attachment, the second pivot attachment, the first elevational axis and the second elevational axis and located in a plane extending substantially perpendicular to the elevational axes define a quadrilateral such that elevational movement of the primary weapon is duplicated by the auxiliary weapon.

4. The armored turret of claim 3 wherein the link rod member comprises means to adjust the distance between the first and second pivot attachments.

5. The armored turret of claim 1 wherein the auxiliary weapon has a mechanically re-settable breech and further comprising:

a) a control device located in the interior of the turret; and, b) mechanical transmission means extending through the hollow support arm and operatively connecting the control device and the breech of the auxiliary weapon.

6. The armored turret of claim 5 wherein the mechanical transmission means comprises a cable-type mechanical transmission.

7. The armored turret of claim 6 wherein the mechanical transmission means further comprises a pulley rotatably attached to the mounting means such that the cable passes at least partially around the pulley.

8. The improved armored turret of claim 1 further comprising ammunition supply means attached to the mounting means so as to supply ammunition to the auxiliary weapon.

9. The improved armored turret of claim 1 further comprising ammunition storage rack means attached to the exterior of the turret.

10. The improved armored turret of claim 1 wherein the auxiliary weapon comprises a grenade launcher.

11. The improved armored turret of claim 1 wherein the auxiliary weapon comprises a machine gun.

* * * * *